US006512584B1

(12) United States Patent
O'Loughlin et al.

(10) Patent No.: US 6,512,584 B1
(45) Date of Patent: Jan. 28, 2003

(54) QUALITY CONTROL FOR LASER PEENING

(75) Inventors: Mark E. O'Loughlin, Galloway, OH (US); Allan H. Clauer, Worthington, OH (US); David W. Sokol, Dublin, OH (US); Jeffrey L. Dulaney, Dublin, OH (US); Steven M. Toller, Grove City, OH (US)

(73) Assignee: LSP Technologies, Inc., Dublin, OH (US)

( * ) Notice: Subject to any disclaimer, the term of this patent is extended or adjusted under 35 U.S.C. 154(b) by 0 days.

(21) Appl. No.: 09/106,793

(22) Filed: Jun. 29, 1998

(51) Int. Cl.[7] ..... G01B 11/00; B05D 3/00; C21D 1/54

(52) U.S. Cl. ..... 356/388; 356/32; 427/554; 148/510

(58) Field of Search ..... 356/256, 388; 219/121.85, 121.68; 427/554; 148/510; 250/559.4, 559.22

(56) References Cited

U.S. PATENT DOCUMENTS

| | | | | | |
|---|---|---|---|---|---|
| 4,492,121 | A | * | 1/1985 | Lehto | 73/705 |
| 4,504,727 | A | * | 3/1985 | Melcher et al. | 219/121 LB |
| 4,937,421 | A | * | 6/1990 | Ortiz, Jr. et al. | 219/121.68 |
| 5,741,559 | A | * | 4/1998 | Dulaney | 427/554 |
| 5,951,790 | A | * | 9/1999 | Mannava et al. | 148/510 |
| 6,002,102 | A | * | 12/1999 | Dulaney et al. | 219/129.85 |
| 6,005,219 | A | * | 12/1999 | Rockstroh et al. | 219/121.85 |

* cited by examiner

*Primary Examiner*—Frank G. Font
*Assistant Examiner*—Roy M. Punnoose
(74) *Attorney, Agent, or Firm*—Randall J. Knuth

(57) ABSTRACT

A method of testing the operation of a laser peening system includes providing a sensor in a possible laser beam path, applying a transparent overlay material to the sensor, directing a pulse of coherent energy to the sensor through the transparent overlay material to create a shock wave, and determining a characteristic of the created shock wave with the sensor.

49 Claims, 5 Drawing Sheets

QUALITY CONTROL FOR LASER PEENING

BACKGROUND OF THE INVENTION

1. Field of the Invention

The present invention relates to the use of coherent energy processes for high powered pulse lasers, in the shock processing of materials, and more particularly, to methods and apparatuses for determining if sufficient energy has been applied to a workpiece to work the part.

2. Description of the Related Art

Known methods of shock processing solid material, in particular laser shock processing solid materials using coherent energy, as from a laser, orient the laser beam normal, i.e., perpendicular to the workpiece.

Laser shock processing techniques and equipment can be found in U.S. Pat. No. 5,131,957 to Epstein.

Problems arise during production, in particular there is difficulty in ascertaining whether the laser peening process has applied sufficient irradiance to correctly work the part. Particular questions to be answered for part quality are that of the amplitude and duration of the pressure pulse applied to the workpiece.

It is difficult to test the processed workpieces, to determine if sufficient pressure has been applied, without destruction of the workpiece.

Previous process quality issues in similar process metal shot peening, have been determined with the use of Almen strips or test coupons. These types of metallic test coupons are in the form of strips formed with a known composition and structure. Such test coupons are standardized in composition, hardness, and thickness. The test strip is placed against a steel block and the entire exposed surface is processed with the appropriate shot peening intensity to be tested. The residual stress introduced by shot peening causes the coupon to arch, and such arch is calculated to be related to the intensity of the peening.

Such test strips or coupons have proven to be unsatisfactory for laser shock peening in that the strips have a large surface area. If the entire surface is laser peened, the test is time consuming and costly. If only a part of the surface of these strips is processed, the sensitivity of the arching to different laser peening intensities is low and not reproducible.

What is needed in the art, is an apparatus or method for directly measuring the pressure pulse generated by the laser beam or a material response relating to laser peening intensity, that can be utilized for each shot or at intervals during laser shock processing. These methods or apparatus should be inexpensive and provide rapid measurement having acceptable accuracy.

SUMMARY OF THE INVENTION

The present apparatus and method is that of a quality control device whereby, periodically during production processing utilizing laser shock peening, the device is inserted into the beam or beams or alternatively monitors the effects produced by each laser shot. The laser is shot at the inventional device instead of the workpiece, to obtain a readout of whether or not the laser peening system is operating within the correct processing range. The system measures the characteristics of the pressure pulse created by the laser beam, not the laser beam itself.

The present invention includes the opportunity to directly measure the pressure or impulse created by the laser peening system by a plurality of methods. One system utilizes a material sensor utilizing the piezoelectric effect. In this case, the pressure pulse passing through the material creates a particular electric response which can be measured and correlated to the applied pressure pulse. Examples of these materials are quartz, lithium niobate and some polymers such as polyvinylidene fluoride (PVDF).

Another possible means of directly measuring the pressure pulse is to utilize materials displaying piezoresistance effects. Examples of these types of materials are manganese, carbon and ytterbium.

Still another method is to utilize fiber optic materials which show a change in refractive index with pressure.

Another type of direct measurement of the pressure pulse may be some type of pressure sensor that may be able to withstand the applied pressure of the laser peening system. Additionally, such measurement systems may include attenuating material that enables reuse of the sensor and/or may be connected to other sensing devices by fluid, such as air, liquid, or solid connections.

Another feature of the invention is that it has the ability of sensing vibrations and elastic waves created by the pressure pulse by using an electronic strip, such as an acoustic sensor or microphone directly attached to the workpiece, to measure the acoustic waves created by the shockwave of the pressure pulse.

For measurement of acoustic signals or responses, the voltage generated by the passage of the pressure pulse through the sensing device may be traced upon an oscilloscope, and such data may then be digitized and saved to create an effective acoustic signature of what would believed to have been a sufficient pressure pulse.

In the above cases, the pressure pulse measured would have to pass through the current operating method of the laser peening system, particularly that being of the appropriate transparent overlay and opaque overlay such that the pressure response, at the measuring device, may be correlated directly to the pressure pulse expected at and to the workpiece.

Another method of measuring the pressure pulse would be to use an indirect measurement, such as a microphone connected to the workpiece, or located in the laser shocking area, or a microphone attached to the workpiece holding tool. Such non-contact sensors may include the use of microphones, a laser acoustic measurement device measuring surface shock waves on the workpiece, or alternatively, bouncing a separate laser beam (at a different wavelength than that of the laser peening system) off the piece and measuring movement of the workpiece surface or vibration caused by the reflected waves. It may be necessary in some types of applications to create a curved adaptor to fit between the microphone and the workpiece, such as a flexible bellows, or some other type of conforming\accommodating apparatus to maximize the contact area. Such contact connection between the measuring device and the workpiece may be made by a clamp, adhesive, or other contact device.

The invention, in one form thereof, is a method of testing the operation of a laser peening system, comprising providing a sensor in a possible laser beam path, applying a transparent overlay material to the sensor; and directing a pulse of coherent energy to the sensor through the transparent overlay material to create a shock wave. The system then determines a characteristic of the created shock wave with the sensor, or measures the affects of the shock wave on the workpiece.

An advantage of the present invention is that it would be reusable between particular laser shock peening parts to ensure that the pressure pulses applied to subsequent workpieces are substantially the same.

Another advantage of the present invention, is that by the use of pressure sensitive devices that may be calibratable, a more accurate reading of the pressure pulses created by the laser peening system is possible. In addition, since the devices may be used more than once, they can be recalibrated after a certain amount of use to further increase their precision.

Another advantage of the present invention, is that the system may have direct or indirect contact with the workpiece.

Yet another advantage of the present invention is the use of nondestructive evaluation techniques in combination and controlling the laser peening system.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
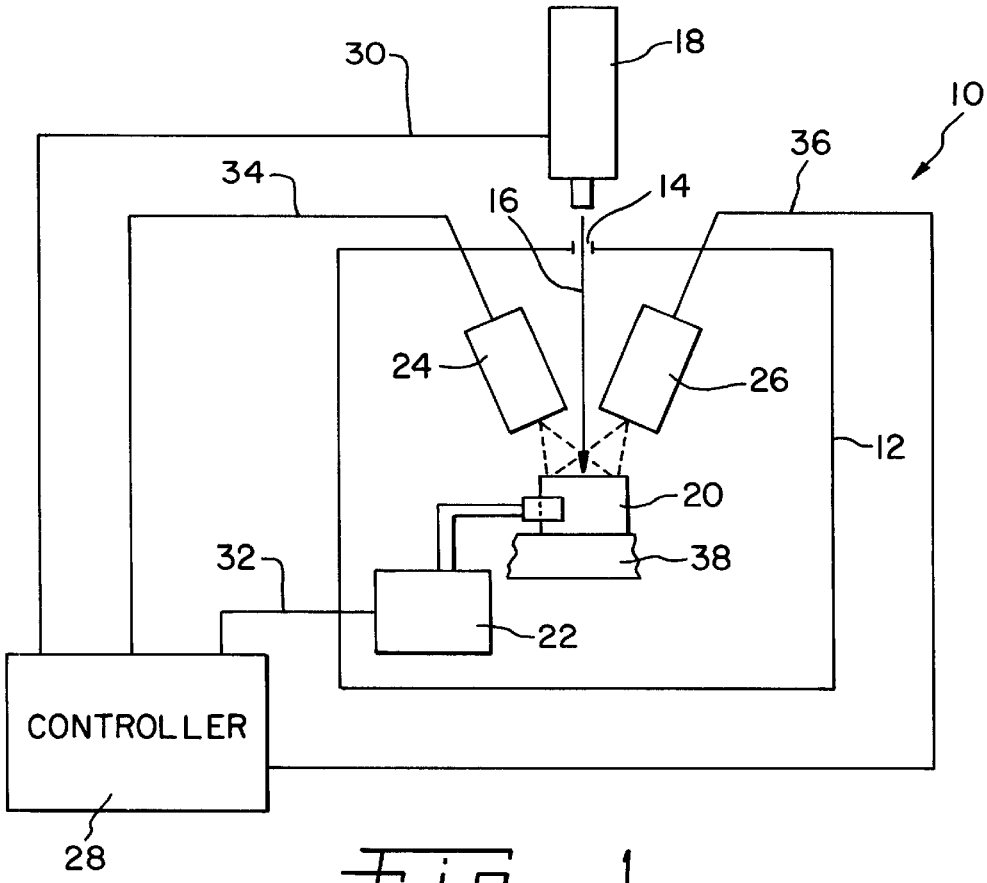
FIG. 1 is a diagrammatic view of a laser processing system for use with the present invention.

Referring now to the drawings, in particular, to FIG. 1, there is shown a laser peening or laser shock peening system 10 of and for use with of the present invention, including a target chamber 12 in which the laser shock process takes place. The target chamber 12 includes an opening 14 for a laser beam 16 created by laser 18, a source of coherent energy. Laser 18, by way of example, may be a commercially available high power pulsed laser system capable of delivering more than approximately 10 joules in 5 to 100 nanoseconds. The laser pulse length and focus of the laser beam may be adjusted as known in the art. Shown in FIG. 1, a workpiece 20 is held in position within target chamber 12 by means of a positioning mechanism 22. Positioning mechanism 22 may be of the type of a robotically controlled arm or other apparatus to precisely position workpiece 20 relative to the operational elements of laser shock system 10.

System 10 includes a material applicator 24 for applying an energy absorbing material onto workpiece 20 to create a coated portion. Material applicator 24 may be that of a solenoid operated painting station or other construction such as a jet spray or aerosol unit to provide a small coated area onto workpiece 20. The material utilized by material applicator 24 is an energy absorbing material, preferably that of a black, water-based paint such as Tricorn Black from The Sherwin Williams Company of Cleveland, Ohio. Another opaque coating that may be utilized is that of ANTI-BOND, a water soluble gum solution including graphite and glycerol from Metco, Company, a Division of Perkin-Elmer of Westbury, N.Y. Alternatively, other types of opaque coatings may be used such as black Scotch™ adhesive tape from 3M of Saint Paul, Minn.

System 10 further includes a transparent overlay applicator 26 that applies a fluid or liquid transparent overlay to workpiece 20 over the portion coated by material applicator 24. Transparent overlay material should be substantially transparent to the radiation as discussed above, water being the preferred overlay material.

As shown in FIG. 1, both material applicator 24 and transparent overlay material applicator 26 are shown directly located within target chamber 12. In a production operation environment, only the necessary operative portions need be located through and within target chamber 12 such as the portion through which the materials actually flow through a flow head. The supply tanks for the transparent overlay materials and other energy absorbing materials may be located outside of target chamber 12. Although not a preferred embodiment, the energy-absorbing coating may be applied entirely outside of the target chamber 12.

A control unit, such as controller 28, is operatively associated with each of the material applicator 24, transparent overlay material applicator 26, laser 18, and positioning mechanism 22. Controller 28 controls the operation and timing of each of the applicators 24, 26, laser 18, and selective operation of positioning mechanism 22 to ensure proper sequence and timing of system 10. Shown in FIG. 1, controller 28 is connected to laser 18, positioning mechanism 22, material applicator 24 and transparent overlay material applicator 26 via control lines 30, 32, 34, and 36, respectively. Controller 28, in one embodiment, may be a programmed personal computer or microprocessor.

In operation, controller 28 controls operation of system 10 once initiated. As shown in FIG. 1, a workpiece 20 is located particularly within target chamber 12 by positioning mechanism 22. Controller 28 activates material applicator 24 to apply a laser energy absorbing coating such as a water-based black paint onto a particular location of workpiece 20 to be laser shock processed. The next step of the process is that controller 28 causes transparent overlay material applicator 26 to apply transparent overlay to the previously coated portion of workpiece 20. At this point, laser 18 is immediately fired by controller 28 to initiate a laser beam 16 to impact the coated portion. Preferably the time between applying the transparent water overlay and the step of directing the laser energy pulse is approximately 0.1 to 3.0 seconds. By directing this pulse of coherent energy to the coated portion, a shock wave is created. As the plasma expands from the impact area, it creates a compressional shock wave passing through and against workpiece 20.

The above-described process or portions of the process are repeated to shock process the desired surface area of a workpiece 20.

The present invention includes apparatus and method steps for determining if the laser peening system 10 is operating in a predetermined manner.

Figure 2:
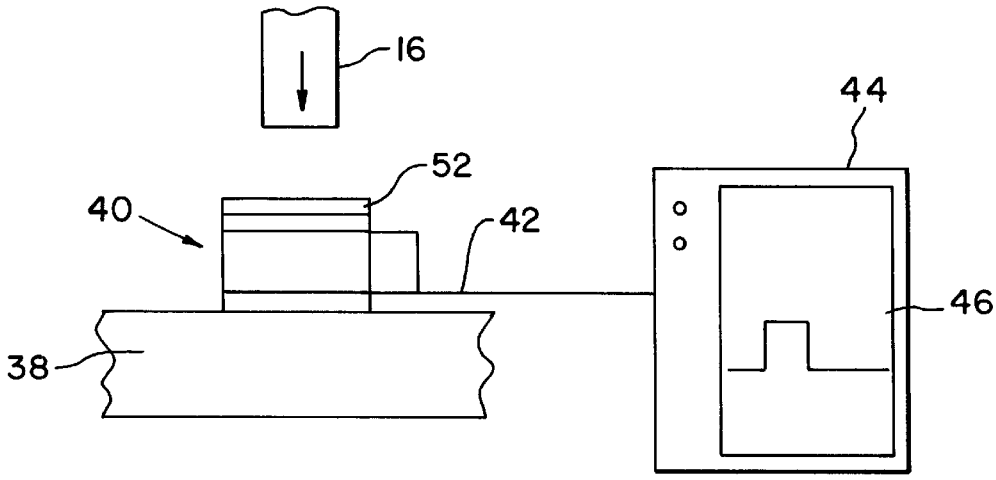
FIG. 2 is a sectional view of one embodiment of the present invention.

The first embodiment of the invention is shown in FIG. 2, in which a sensor 40 is utilized to directly measure the pressure pulse or other characteristic generated by laser beam 16 at intervals during laser shock processing. Sensor 40 is mounted to a base 38. In this embodiment, and others to be discussed, the laser peening system 10 may apply both opaque and transparent overlay material to sensor 40 and base 38, and other monitoring elements to more precisely monitor peening system 10 operation. Sensor 40 is utilized in line with the possible or intended path of laser beam 16.

Sensor 40 may comprise a material sensor such as quartz, or differing types of metallic, ceramic, or plastic, materials that develop, form, or modify a measurable signal on the impact or passage of the pressure shock wave created by the impact of laser beam 16 with sensor 40. Piezoelectric materials such as quartz or PVDF may be used. These gages generate a current between electrodes on opposite surfaces of the gage, which is measured on an oscilloscope or digitally captured and calibrated to the pressure sensed by the gauge material.

Alternatively, piezoresistive pressure sensors may be utilized such as manganese, carbon and ytterbium. The signal from these sensors is in the form of a change of voltage across the gauge, which is captured on an oscilloscope or other means.

Figure 3:
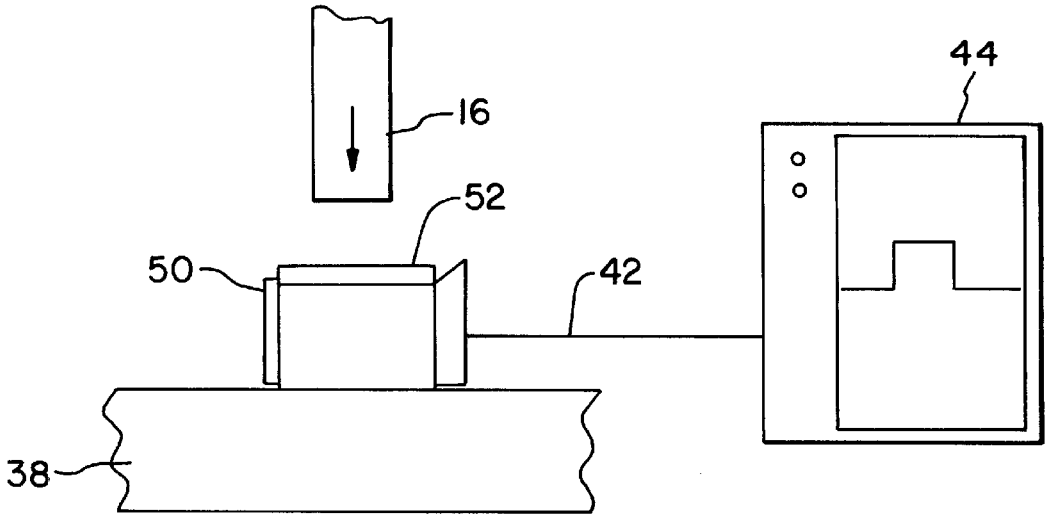
FIG. 3 is a section view of another embodiment of the present invention.

Other types of sensors may be utilized to directly measure a characteristic, an impact, or pressure wave created by incoming laser beam 16, such as the fiber optic disclosed below (FIG. 3).

Signals created by sensor 40 would be communicated to a communication harness or pickup wire harness 42 to a measuring means 44, such as an oscilloscope or alternate analog or digital signal measuring, storing or display device. As shown in FIG. 2, a characteristic waveform 46 may be displayed from the signal generated by sensor 40. Such waveforms may then be analyzed by conventional signal processing systems, such as comparing the measured waveform to a historical database of waveforms, to determine if the such new waveform indicates a successful laser peening operation.

FIG. 3 shows the invention utilizing a fiber optic sensor 50 which would exhibit a known change of refractive index caused by a change of pressure during a successful or desired laser peening operation. An optical signal detection system to measure the effect of the change of refractive index could be embedded or disposed in wiring harness 42. Such structure would send a signal, representative of the change in refractive index of fiber optic 50, to the oscilloscope or other signal measuring, display, or storing device 44.

Sensors 40 and 50 may need to use some type of laser or pressure attenuator 52 to prevent damage or destruction by the impact of laser beam 16. Such attenuating materials may comprise optical materials, rubber, plastic, or metals.

Preferably such materials would attenuate any of the harmful effects of laser beam 16, while not affecting the creation of the sensor's signal relative to the measured laser beam 16 characteristic or pressure pulse created. Alternatively, but less preferably, the attenuating materials would protect the sensor and only linearly change the created signal, thereby enabling simpler signal processing equipment and methods than if such attenuating material operated to change the created signal in a complex or multivariant fashion.

Figure 4:
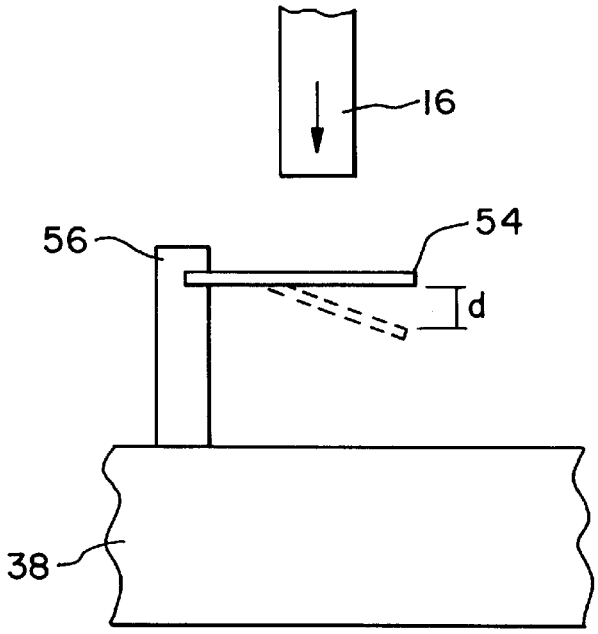
FIG. 4 is a sectional view of yet another embodiment of the present invention.

FIG. 4 shows another embodiment of the present invention, in which a deformable coupon 54 is utilized to measure a characteristic of laser peening system 10 and laser beam 16 by the amount of deformation "d", as measured from a starting point. As shown in FIG. 4, coupon 54 is held by a clamp 56 or other suitable means to base 38, and such coupon 54 is shown with a possible deformation, in phantom line. Based on the material utilized for coupon 54, the amount of deformation "d" created by a hit of laser beam 16 may be correlated to a specific quantity, such as the irradiance, potential compressive residual force, or impulse possibly created by laser beam 16. The advantage of this system is that only one or a few shots would be necessary to achieve substantial, measurable deflection.

Example materials for the deformable coupon include aluminum, steel, stainless steel, iron, nickel, copper, titanium, and other metals and alloys thereof.

Figure 5:
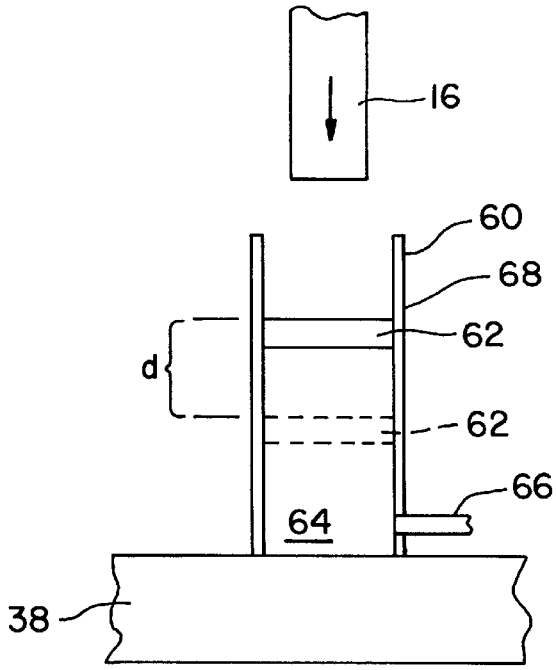
FIG. 5 is a sectional view of another embodiment of the present invention.
Figure 6:
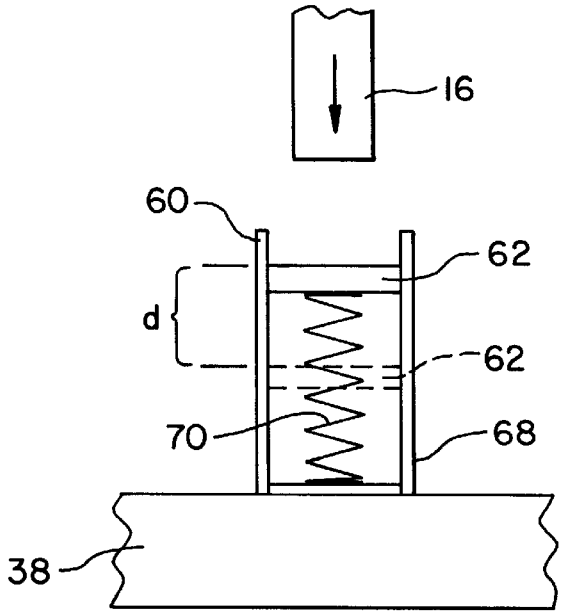
FIG. 6 is a sectional view of the embodiment of the invention shown in FIG. 5 utilizing a spring instead of fluid.

FIGS. 5 and 6 disclose another structure and method of determining a characteristic of laser peening system 10 and particularly laser beam 16 hitting a mechanical impulse gauge. A cylinder 60 is shown with a movable piston 62 disposed therein. Movement of piston 62 is aligned with the potential path of laser beam 16. Such cylinder/piston apparatus acts to measure the impact effects of laser beam 16 by displacing a liquid or fluid 64 disposed behind piston 62 relative to incoming laser beam 16. Such fluid 64 may comprise water or other suitable fluid. On impact of laser beam 16, piston 62 will move from its initial position to a second position (indicated in phantom line). Such movement of piston 62 will cause fluid 64 to be ejected out of cylinder 60 through outlet 68. Such ejected fluid may then be measured to determine the displacement d of piston 62. Additionally and alternatively, cylinder 60 may be transparent or have an optical window 68 to view and measure the displacement of piston 62.

FIG. 6 shows an alternative to using a damping or viscous fluid 64, particularly that of a spring 70. Such spring 70 may be sized and designed to compress a predetermined amount on application of a laser beam 16 with the desired characteristics. Other equivalent mechanical impulse gauges include pendulum type devices.

Figure 7:
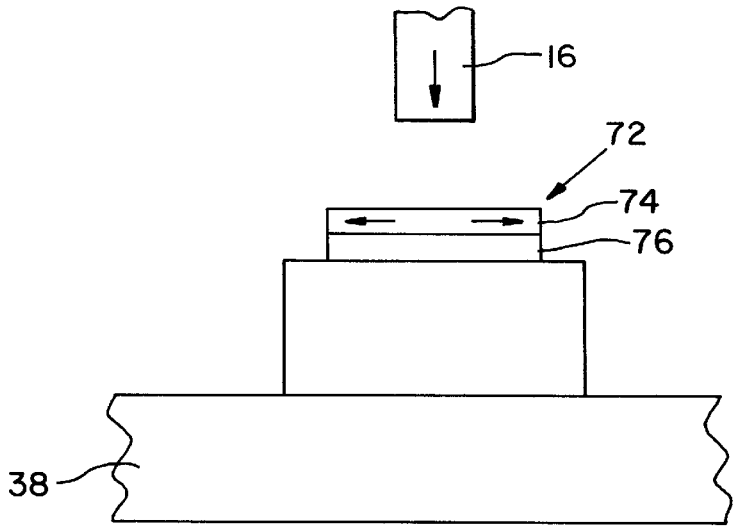
FIG. 7 is a sectional view of another embodiment of the present invention utilizing a bi-metallic or metal-plastic strip.

FIG. 7 shows another embodiment of the present invention, in which a deformable bi-metallic coupon or metallic-plastic 72 is utilized as a sensor to measure a characteristic of laser peening system 10 and laser beam 16 by the amount of deformation "d" (FIG. 8), as measured from a starting point. As shown in FIG. 7, bimetallic coupon 72 is placed on base 38 and held by a clamp or other means thereto.

Figure 8:
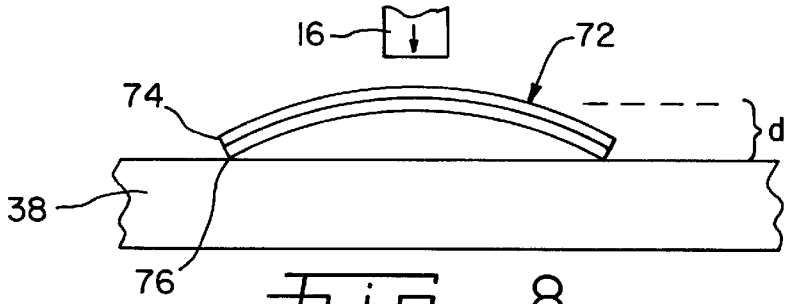
FIG. 8 is a sectional view of the embodiment of FIG. 7, after being laser shock peened.

FIG. 8 shows bimetallic coupon 72 after impact by laser beam 16. Based on the materials utilized for coupon 72, the amount of deformation "d" created by a hit of laser beam 16 may be correlated to a specific quantity, such as compressive residual stresses possibly created by laser beam 16.

Of operational concern is that the two layers, 74 and 76 of bimetallic coupon 72 exhibit differing elastic modulus. This quality ensures that bimetallic coupon 72 will arch or bend with impact of laser beam 16 with increased sensitivity to process conditions as compared to a monolithic strip.

Example materials for the bimetallic coupon include the same materials listed above for the deformable coupon with the addition of plastic materials. Preferable combinations of materials for layers 74 and 76 respectively include, steel on one side of the coupon, and aluminum on the other. Relative thicknesses may differ between the layers. Of importance is the difference in the Young's Modulus or elastic modulus between the layers. The layer having the higher modulus should be the layer directly impacted first by the laser beam.

Alternatively, the coupon can comprise of a metallic layer and a plastic layer, each selected to provide a high impedance mismatch between the two materials. The metallic layer having the higher impedance should be on the side toward the beam. In this combination, the shock wave first travels through the metallic layer forming residual compressive stresses. Upon reaching the interface between the metallic and plastic materials, a portion of the shock wave will reflect back into the metal layer from this interface as a compression wave, due to the higher impedance of the metal. This will create additional compressive residual stress in the metallic layer. Upon reaching the original laser shocked surface, the shock wave will then have attenuated to a level such that as a reflected tensile wave, it no longer has a significant effect on the existing compressive stresses.

The increased compressive residual stresses in the metallic layer will increase the amount of arching of the composite strip. The lower stiffness of the plastic layer will also enhance the amount of arching observed.

Still another alternative is to have a coupon comprising of three layers of materials (not shown). These coupons would have a combination of metallic and plastic layers.

Figure 9:
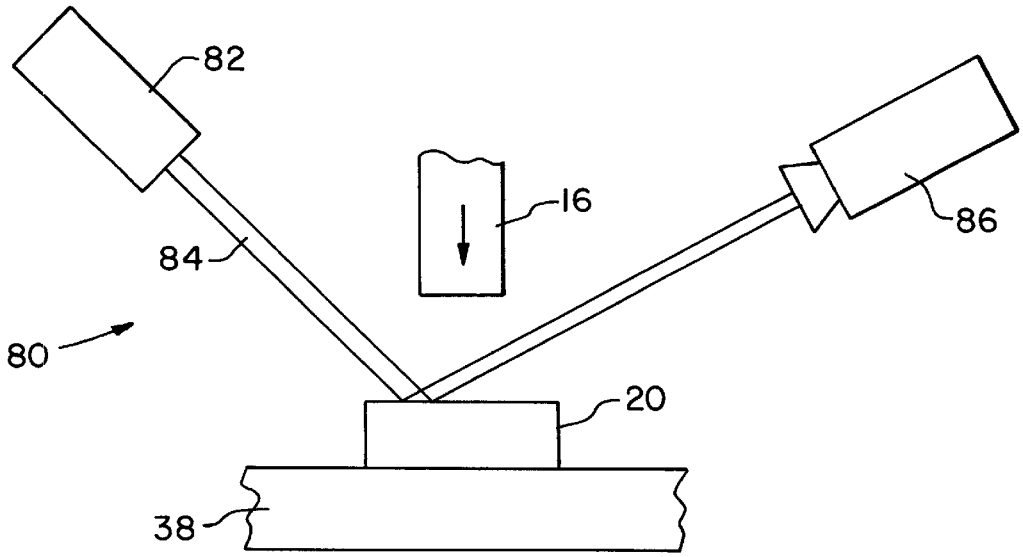
FIG. 9 is a sectional view of another embodiment of the present invention utilizing a second laser which is reflected from the workpiece and measured.

FIG. 9 shows a method of determining the vibration or deformation of a workpiece 20 utilizing a laser apparatus 80. Laser apparatus 80 includes a laser 82 creating a laser beam 84 at a different wavelength than laser beam 16 from laser peening system 10. Laser beam 84 is reflected from workpiece 20 to a laser beam receiver device 86. By measuring and monitoring reflected laser beam 84, the vibration of the workpiece in response to the shock wave, or shock wave propagation through workpiece 20 may be measured. Such measurement may be correlated to the desired characteristics to be measured of laser beam 16 or laser peening system 10.

Another embodiment of a sensor system of the present invention includes the use of indirect measurement of characteristics of the impact of laser beam 16 to workpiece 20. One such measurable feature is that of the shockwave as measurable by a microphone or similar acoustic sensor 90. The shockwave created by the impact of laser beam 16 creates an acoustic wave that may be measured, sampled, and analyzed.

Figure 10:
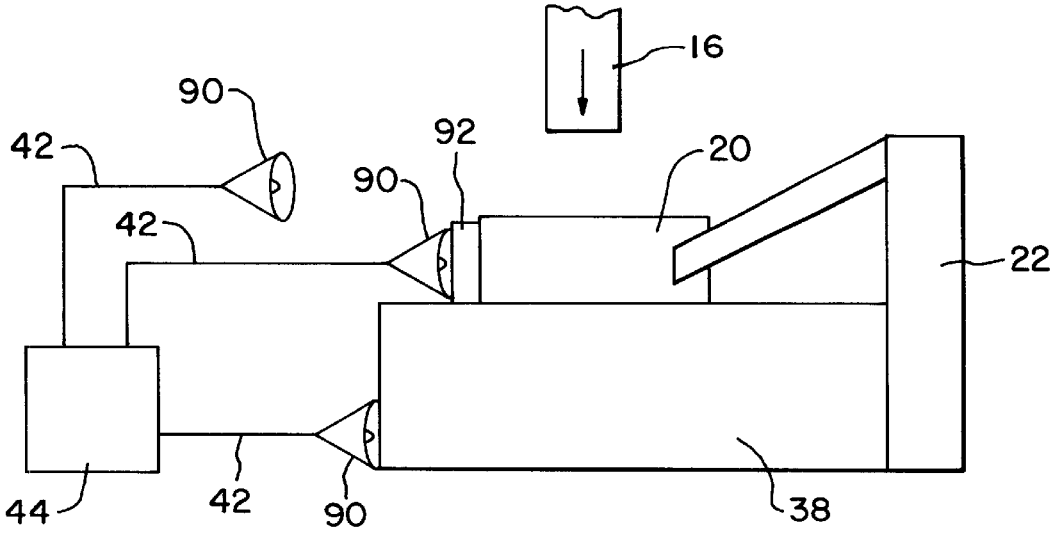
FIG. 10 is a front elevational view of another embodiment of the present invention utilizing contact and non-contact sensors.

As shown in FIG. 10, acoustic sensors 90 may be located at various locations relative to the workpiece 20 and laser beam 16. Particular locations of interest include attaching a sensor 90 to workpiece 20, (possibly through an attenuating material 92 similar to attenuator 52), attaching the sensor 90 to a workpiece base 38 or part holder 22, or locating sensor 90 in an area adjacent to the shock peening operation.

The acoustic signal created by sensors 90 are passed to a measuring means or unit 44 by a communication line 42. Measuring means 44 may include displaying the voltage created by sensor 90 on an oscilloscope. Additionally, comparison of a current signal to a historical signal may be accomplished. Such sensors 90 in some forms may be defined as non-contact sensors, i.e., sensors that may determine particular characteristics of the impact of laser beam 16 or operation of laser peening system 10 processing. workpiece 20, without being physically connected to the workpiece.

In some geometries of workpieces 20, in which attachment of an acoustic sensor 90 is desired, it may be necessary to include a filler piece, such as attenuator 92 in FIG. 10 for transmitting, controlling, and/or ensuring that sufficient acoustical energy is applied to sensor 90. In this manner, the attenuator functions as a conduit for communicating acoustic energy from the workpiece to sensor 90. Attenuator 92 may be shaped to conform to workpiece 20.

Figure 11:
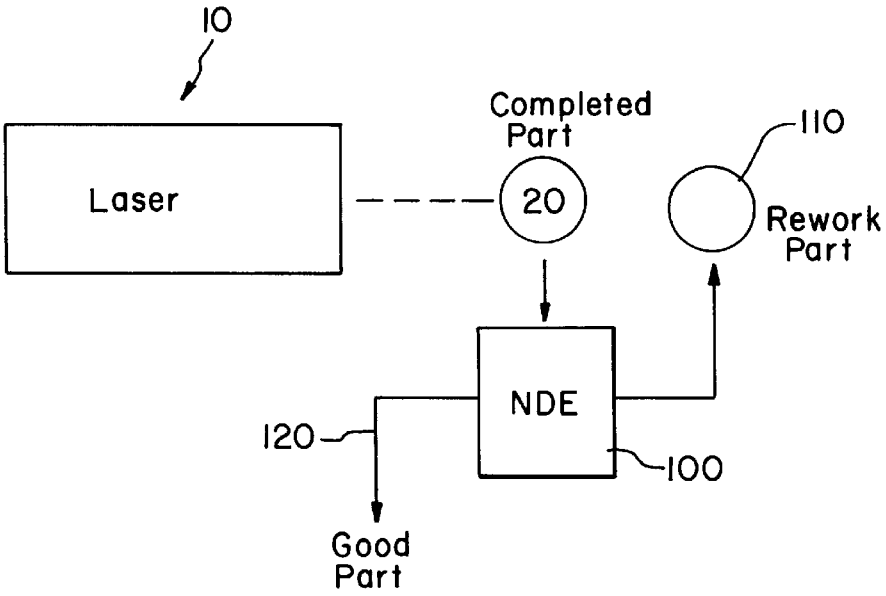
FIG. 11 is a flowchart of workpiece movement through a laser peening system incorporating a nondestructive testing station.

Other sensors may be utilized for nondestructive evaluation (NDE) of workpiece 20, as shown in FIG. 11. Such sensors may be based on utilization of eddy current, ultrasonic, and/or X-ray diffraction measurements. Sensors 100 (FIG. 11) utilizing such effects are used to determine the actual residual compressive stress produced in a particular workpiece 20. NDE sensors and sensing operations may take place after an entire workpiece 20 is laser peened, or may be utilized between particular shots, steps, or layers of laser processing on workpiece 20. NDE sensors work by measuring the variations in speed of sound (ultrasonics), electrical resistance (eddy current systems), or crystal lattice distortions (X-ray diffraction) caused by the residual stresses with associated material changes formed in the workpiece by the laser peening system.

In the acoustic sensing system described above there is a difference in measurement sources depending upon the measurement location. Direct connection to workpiece gives more information on the intensity of the shockwave. Adjacent location of sensors normally gives more information regarding the surface interaction of the plasma formed by the laser system 10 on workpiece 20.

In operation, the laser peening system 10 may operate to apply transparent overlay to a workpiece and create a laser beam and apply the laser beam through the overlay to workpiece. In such system the sensor ( i.e., any of the operational ones described above) may be associated with the laser to collect particular information regarding the operation of the laser peening system 10 or of laser beam 16. Such information may be related to parameters of actual compressive residual stress imparted to workpiece 20.

Use of the non-destructive testing sensors or monitors may be used on every workpiece laser peened or on selective laser peened work pieces such as every third piece, etc. As shown in FIG. 11, after laser peening with system 10, the workpiece 20 is moved to a NDE testing station 100. If workpiece 20 was not in a specification range as determined by the NDE sensor 100 and associated control circuitry, workpiece 20 would be moved to a rework station 110. Such workpiece would then be laser peened again. If the workpiece was in specification, workpiece 20 and possibly the other workpieces it represents, would be considered a "good part" and moved out of the system. The workflow described shows an integration of an NDE sensing system with a laser peening system.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of testing the operation of a laser peening system, comprising:

providing a sensor in a possible laser beam path;

selectably applying a process overlay to said sensor, said process overlay including at least one of a transparent overlay material and an opaque overlay material;

directing a pulse of coherent energy to said sensor through the applied process overlay to create a shock wave; and determining a characteristic of the created shock wave with said sensor.

2. The method of claim 1 in which said providing step utilizes a piezoelectric sensor.

3. The method of claim 1 in which said providing step utilizes a fiber optic sensor.

4. The method of claim 1 in which said providing step utilizes a deformable coupon as said sensor.

5. The method of claim 1 in which said providing step utilizes a piston within a cylinder as said sensor.

6. The method of claim 5 in which said cylinder contains fluid.

7. The method of claim 5 in which said cylinder contains a spring.

8. The method of claim 1 in which said providing step utilizes a deformable bi-metallic coupon.

9. The method of claim 8 in which said bi-metallic coupon comprises two metals having differing elastic modulus properties.

10. The method of claim 8, wherein the step of selectably applying a process overlay to said sensor further includes the steps of:

applying an opaque overlay material to said sensor; and applying a transparent overlay material to the applied opaque overlay material.

11. The method of claim 1, wherein the step of selectably applying a process overlay to said sensor further includes the steps of:

applying an opaque overlay material to said sensor; and applying a transparent overlay material to the applied opaque overlay material.

12. An apparatus for improving properties of a workpiece by providing shock waves therein, comprising:

an applicator assembly for applying a process overlay to said workpiece, said workpiece process overlay including at least one of a transparent overlay material and an opaque overlay material;

a laser operatively associated with said applicator assembly to provide a laser beam through the workpiece process overlay to create a shock wave on the workpiece;

a sensor operatively associated with said laser and having a process overlay applied thereto, said sensor process overlay including at least one of a transparent overlay material and an opaque overlay material, said sensor being selectively placed into the laser beam path at preselected times to enable the laser beam to communicate with said sensor through the sensor process overlay and create a shock wave, said sensor for providing a measure of an effect of the laser beam upon said sensor; and a means to determine a characteristic of the created sensor shock wave utilizing the laser beam effect measurement provided by said sensor.

13. The apparatus of claim 12 in which said sensor comprises a piezoelectric sensor.

14. The apparatus of claim 13 further comprising a means for monitoring output from said sensor.

15. The apparatus of claim 12 in which said sensor comprises a fiber optic sensor.

16. The apparatus of claim 15 further comprising an means for monitoring the output of said fiber optic sensor.

17. The apparatus of claim 12 in which said sensor comprises a deformable coupon.

18. The apparatus of claim 12 in which said sensor comprises a piston slidable within a cylinder.

19. The apparatus of claim 18 in which said cylinder contains fluid.

20. The apparatus of claim 18 in which said cylinder contains a spring.

21. The apparatus of claim 12 in which said sensor comprises a bi-metallic coupon constructed of two metals having differing elastic modulus.

22. The apparatus of claim 12 further comprising a means for monitoring output from said sensor.

23. The apparatus of claim 12 wherein said applicator assembly further comprising a transparent overlay applicator for applying a transparent overlay to said workpiece, and an opaque overlay applicator operatively associated with said laser.

24. An apparatus for improving properties of a workpiece by providing shock waves therein, comprising:

an applicator assembly for applying a process overlay to said workpiece, said process overlay including at least one of a transparent overlay material and an opaque overlay material;

a laser operatively associated with said applicator assembly to provide a laser beam through the process overlay to create a shock wave on the workpiece; and a sensor operatively associated with said laser, said sensor for collecting information regarding the acoustic response of said workpiece to the laser beam.

25. The apparatus of claim 24 in which said sensor is a microphone.

26. The apparatus of claim 25 in which said microphone is located directly adjacent to the workpiece.

27. The apparatus of claim 25 in which said microphone is located operationally adjacent to the workpiece.

28. The apparatus of claim 25 in which said microphone is connected to the workpiece by an attenuator member.

29. The apparatus of claim 25 further including a workpiece holder, said microphone is located adjacent to said workpiece holder.

30. The apparatus of claim 24 further comprising a second laser to apply a second laser beam to and reflect from the workpiece, and an optical receiver for measuring the reflected second laser beam to determine a vibration signature of the workpiece.

31. An apparatus for improving properties of a workpiece by providing shock waves therein, comprising:

an applicator assembly for applying a process overlay to said workpiece, said process overlay including at least one of a transparent overlay material and an opaque overlay material;

a laser operatively associated with said applicator assembly to provide a laser beam through the process overlay to create a shock wave on the workpiece; and a nondestructive evaluation sensor operatively associated with said laser, said sensor for measuring an effect of said laser beam on said workpiece.

32. The apparatus of claim 31 in which said sensor is an eddy current sensor.

33. The apparatus of claim 31 in which said sensor is an ultrasonic sensor.

34. The apparatus of claim 31 in which said sensor is an X-ray diffraction measurement device.

35. The apparatus of claim 31 further comprising a means for reprocessing the workpiece if the effect measured by said sensor is outside of a predetermined range.

36. A method of testing the operation of a laser peening system, comprising:

providing a workpiece in a possible laser beam path;

directing a pulse of coherent energy to said workpiece to create a shock wave therein;

determining a characteristic response of said workpiece to the created shock wave with a nondestructive evaluation sensor;

determining whether the determined characteristic response of said workpiece is within a predetermined specification range; and redirecting another pulse of coherent energy to said workpiece if the determined characteristic response is outside said predetermined specification range.

37. The method of claim 36 in which said workpiece response determining step utilizes an eddy current sensor.

38. The method of claim 36 in which said workpiece response determining step utilizes an ultrasonic sensor.

39. The method of claim 36 in which said workpiece response determining step utilizes an X-ray diffraction measurement device.

40. The apparatus as recited in claim 24, wherein said sensor being operatively arranged in non-contacting acoustic sensing relationship with said workpiece.

41. The apparatus as recited in claim 24, wherein said sensor being operatively arranged in direct contact with said workpiece.

42. The apparatus as recited in claim 24, wherein said sensor being operatively arranged in indirect coupling relationship with said workpiece.

43. The apparatus as recited in claim 24, wherein the acoustic response information collected by said sensor defines an acoustic signature of the shock wave.

44. The apparatus as recited in claim 31, wherein the laser beam effect measured by said sensor being indicative of compressive residual stresses present in said workpiece from the created shock wave.

45. The apparatus as recited in claim 31, further comprising:

a means to determine compressive residual stresses present in said workpiece based upon the laser beam effect measured by said sensor.

46. A system, comprising:

a laser shock processing system operatively arranged to perform a laser shock processing operation on a workpiece involving the creation of a shock wave;

a test laser operatively arranged to apply a test laser beam to and reflect from the workpiece; and an optical detector operatively arranged to receive the reflected test laser beam, the reflected test laser beam being representative of the effect of the laser shock processing operation on said workpiece.

47. The system as recited in claim 46, wherein the reflected test laser beam providing an indication of vibrational activity present in said workpiece.

48. The system as recited in claim 47, wherein the workpiece vibrational activity indicated by the reflected test laser beam occurring in response to the created shock wave and defining a vibration signature.

49. The system as recited in claim 46, wherein the reflected test laser beam providing an indication of deformation activity present in said workpiece.

* * * * *